US009948016B2

(12) United States Patent
Chen et al.

(10) Patent No.: US 9,948,016 B2
(45) Date of Patent: Apr. 17, 2018

(54) USB TYPE CONNECTOR HAVING STRUCTURALLY INTEGRATED COMPONENTS

(71) Applicant: ADVANCED-CONNECTEK INC., New Taipei (TW)

(72) Inventors: Ching-Tien Chen, New Taipei (TW); Shu-Lin Duan, New Taipei (TW); Wei Wan, New Taipei (TW); Xiao-Juan Qi, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/259,631

(22) Filed: Sep. 8, 2016

(65) Prior Publication Data

US 2017/0070009 A1 Mar. 9, 2017

(30) Foreign Application Priority Data

Sep. 9, 2015 (CN) ..... 2015 1 0568714

(51) Int. Cl.

| | |
|---|---|
| ***H01R 13/405*** | (2006.01) |
| ***H01R 13/11*** | (2006.01) |
| ***H01R 13/6581*** | (2011.01) |
| ***H01R 13/6596*** | (2011.01) |
| ***H01R 43/24*** | (2006.01) |
| *H01R 107/00* | (2006.01) |

(52) U.S. Cl.

CPC ..... *H01R 13/11* (2013.01); *H01R 13/405* (2013.01); *H01R 13/6581* (2013.01); *H01R 13/6596* (2013.01); *H01R 43/24* (2013.01); *H01R 2107/00* (2013.01)

(58) Field of Classification Search

CPC .... H01R 13/40; H01R 13/405; H01R 13/514; H01R 13/516; H01R 24/60

USPC ..... 439/607.05, 607.01, 607.08, 676, 701

See application file for complete search history.

(56) References Cited

U.S. PATENT DOCUMENTS

| | | | | |
|---|---|---|---|---|
| 9,450,337 | B2 * | 9/2016 | Kao | H01R 13/6461 |
| 9,728,885 | B2 * | 8/2017 | Yokoyama | H01R 13/502 |
| 2016/0020569 | A1 * | 1/2016 | Ju | H01R 24/78 439/607.01 |
| 2016/0072242 | A1 * | 3/2016 | Yu | H01R 24/70 439/95 |

(Continued)

*Primary Examiner* — Vanessa Girardi

(74) *Attorney, Agent, or Firm* — Muncy, Geissler, Olds & Lowe, P.C.

(57) ABSTRACT

An electrical plug connector includes a metallic shell, an insulated housing, a grounding plate, a first terminal module, a second terminal module, and a molding block. The first terminal module includes first plug terminals and a first combining block. The second terminal module includes second plug terminals and a second combining block. The insulated housing is received in the metallic shell. The first and the second combining blocks are respectively combined with the first plug terminals and the second plug terminals by insert-molding techniques. Then, the first combining block and the second combining block are respectively assembled to the grounding plate. Next, the molding block is provided to combine the first combining block with the second combining block, so that an assembly of the first terminal module, the second terminal module, and the grounding plate can be firmly assembled to the rear of the insulated housing.

10 Claims, 11 Drawing Sheets

(56) References Cited

U.S. PATENT DOCUMENTS

2017/0110821 A1* 4/2017 Oyake ..... H01R 13/405

* cited by examiner

100

| | | | | | | | | | | | | |
|---|---|---|---|---|---|---|---|---|---|---|---|---|
| GND | RX2+ | RX2- | VBUS | RFU | D- | D+ | CC1 | VBUS | TX1- | TX1+ | GND | 41 |
| GND | TX2+ | TX2- | VBUS | CC2 | D+ | D- | RFU | VBUS | RX1- | RX1+ | GND | 51 |

Fig. 4

USB TYPE CONNECTOR HAVING STRUCTURALLY INTEGRATED COMPONENTS

CROSS-REFERENCES TO RELATED APPLICATIONS

This non-provisional application claims priority under 35 U.S.C. § 119(a) on Patent Application No. 201510568714.7 filed in China, P.R.C. on 2015 Sep. 9, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical plug connector includes an insulated core, upper and lower plug terminals on the insulated core, and an outer iron shell enclosing the insulated core. Normally, the insulated core of a conventional USB type-C electrical plug connector is an assembly of several plastic components, and the upper plug terminals and the lower plug terminals are respectively assembled with the plastic components.

SUMMARY OF THE INVENTION

However, since the plastic components of the conventional USB type-C electrical plug connector are combined with each other by assembling, the combination between the plastic components and the respective plug terminals are not sufficient. For instance, since the plastic components are not combined with each other by adhesives, each of the plastic components in the assembly is remain independent from each other. Consequently, the overall structural strength of the assembly is not sufficient. As a result, when the connector is used for a period of time, the plastic components may be detached from the plug terminals. Accordingly, how to improve the existing electrical plug connector becomes an issue.

In view of these, an exemplary embodiment of the instant disclosure provides an electrical plug connector. The electrical plug connector comprises a metallic shell, an insulated housing, a grounding plate, a first terminal module, a second terminal module, and a molding block. The metallic shell has a receiving cavity therein. The insulated housing is received in the receiving cavity of the metallic shell. The insulated housing comprises a first assembling portion and a second assembling portion corresponding to the first assembling portion. An insertion cavity is between the first assembling portion and the second assembling portion. A plurality of terminal groove is respectively formed on the first assembling portion and the second assembling portion. The terminal grooves are in communication with the insertion cavity. An opening of the insertion cavity is on one of two sides of the insulated housing, and an assembling recess is recessed from the other side of the insulated housing. The grounding plate is on the insulated housing. The grounding plate comprises a central combining plate, a positioning hole, and a plurality of side arms. The central combining plate is held in the assembling recess. The positioning hole is defined through the central combining plate, and the side arms are respectively extending toward the insertion cavity from two sides of the central combining plate. The first terminal module comprises a plurality of first plug terminals, a first combining block, and a combining hole. Each of the first plug terminals is held in the first assembling portion. One end of each of the first plug terminals is passing through the corresponding terminal groove and extending toward the insertion cavity. The first combining block is formed with the first plug terminals and positioned on one of two surfaces of the central combining plate. The combining hole is defined through the first assembling block and corresponding to the positioning hole. The second terminal module comprises a plurality of second plug terminals and a second combining block. Each of the second plug terminals is held in the second assembling portion. One end of each of the second plug terminals is passing through the corresponding terminal groove and extending toward the insertion cavity. The second combining block is formed with the second plug terminals and positioned on the other surface of the central combining plate. The molding block is in the combining hole, and the molding block is extending from the combining hole, through the positioned hole, to two sides of the second combining block.

In one embodiment, the grounding plate comprises a plurality of engaging grooves on two sides of the central combining plate. The first terminal module comprises a plurality of engaging blocks each protruding from the first combining block and engaged with the corresponding engaging groove.

In one embodiment, the grounding plate comprises a rear protruding block outward extending, from one side of the central combining plate, out of the insulated housing.

In one embodiment, each of the side arms comprises an elastic contact portion and a leg. Each of the elastic contact portions is formed on a front portion of the corresponding side arm, and each of the legs is outward extending, from a rear portion of the corresponding side arm, out of the insulated housing.

In one embodiment, each of the elastic contact portions is a wavy shaped structure. The wavy shaped structures are opposite with each other. Each of the wavy shaped structures comprises a plurality of peak portions and a plurality of valley portions in series connection. A distance between the peak portions near to the opening of the insertion cavity is less than a distance between the peak portions within the insertion cavity.

In one embodiment, each of the side arms comprises a root portion and a contact end. The root portions are at two sides of the central combining plate. The contact ends are in two sides of the insertion cavity. A distance between the contact ends is less than a distance between the root portions.

In one embodiment, the grounding plate comprises an embedded block protruding from a front end of the central combining plate and assembled to the insulated housing.

In one embodiment, the electrical plug connector further comprises a plurality of abutting sheets each comprises a body, a pin, and an extension sheet. The bodies are fixed on the first assembling portion and the second assembling portion. Each of the pins is extending outward from a surface of the corresponding body and in contact with an inner wall of the metallic shell. Each of the extension sheets is extending from a rear portion of the corresponding body and in contact with the inner wall of the metallic shell.

As above, the first combining block is formed with the first plug terminals by insert-molding techniques, and the second combining block is formed with the second plug terminals by insert-molding techniques. Then, the first combining block (along with the first plug terminals) and the second combining block (along with the second plug terminals) are respectively assembled to the upper portion and the lower portion of the grounding plate, so that the first combining block, the second combining block, and the central combining plate can be firmly assembled with each other. Moreover, because of the structure of the side arms which may be obliquely aligned or may have a wavy shaped structure, the side arms can provide a spring force. Accordingly, when the electrical plug connector is mated with an electrical receptacle connector, the side arms can hold the electrical receptacle connector firmly.

Furthermore, the first plug terminals and the second plug terminals are arranged upside down, and the pin-assignment of the first flexible contact portions is left-right reversal with respect to that of the second flexible contact portions. Accordingly, the electrical plug connector can have a 180 degree symmetrical, dual or double orientation design and pin assignments which enables the electrical plug connector to be mated with a corresponding receptacle connector in either of two intuitive orientations, i.e. in either upside-up or upside-down directions. Therefore, when the electrical plug connector is inserted into the electrical receptacle connector with a first orientation, the first flexible contact portions are in contact with upper-row receptacle terminals of the electrical receptacle connector. Conversely, when the electrical plug connector is inserted into the electrical receptacle connector with a second orientation, the second flexible contact portions are in contact with the upper-row receptacle terminals of the electrical receptacle connector. Note that, the inserting orientation of the electrical plug connector is not limited by the electrical receptacle connector.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 4 illustrates a schematic configuration diagram of the plug terminals of the electrical plug connector;

DETAILED DESCRIPTION

Figure 1:
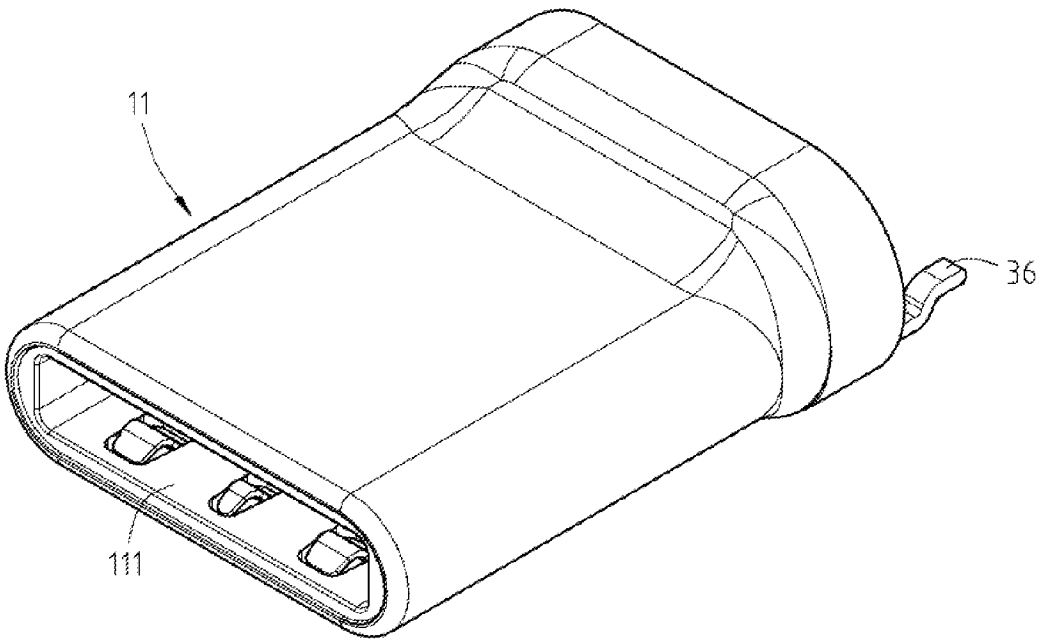
FIG. 1 illustrates a perspective view of an electrical plug connector according to a first embodiment of the instant disclosure.
Figure 2:
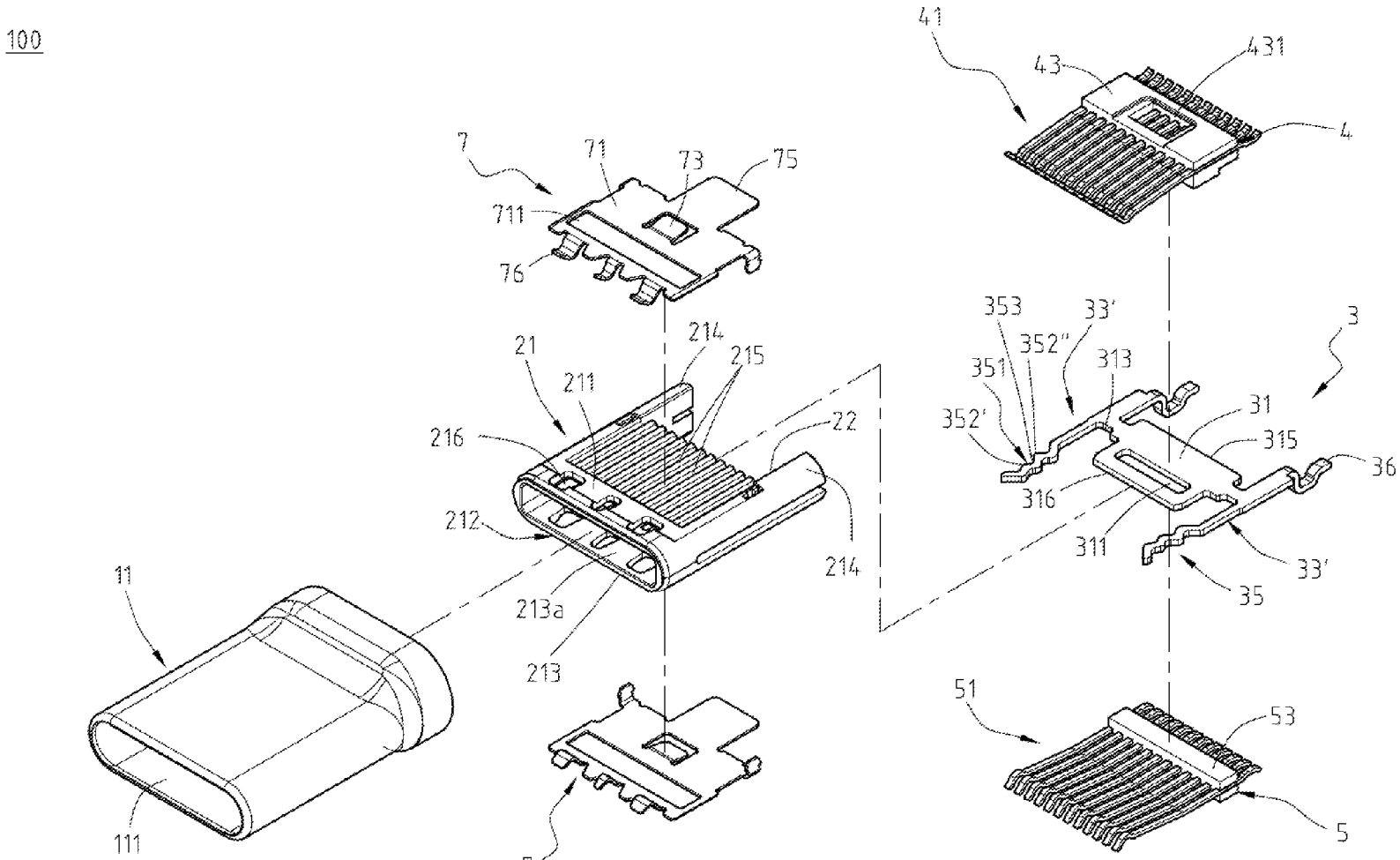
FIG. 2 illustrates an exploded view of the electrical plug connector of the first embodiment.
Figure 3:
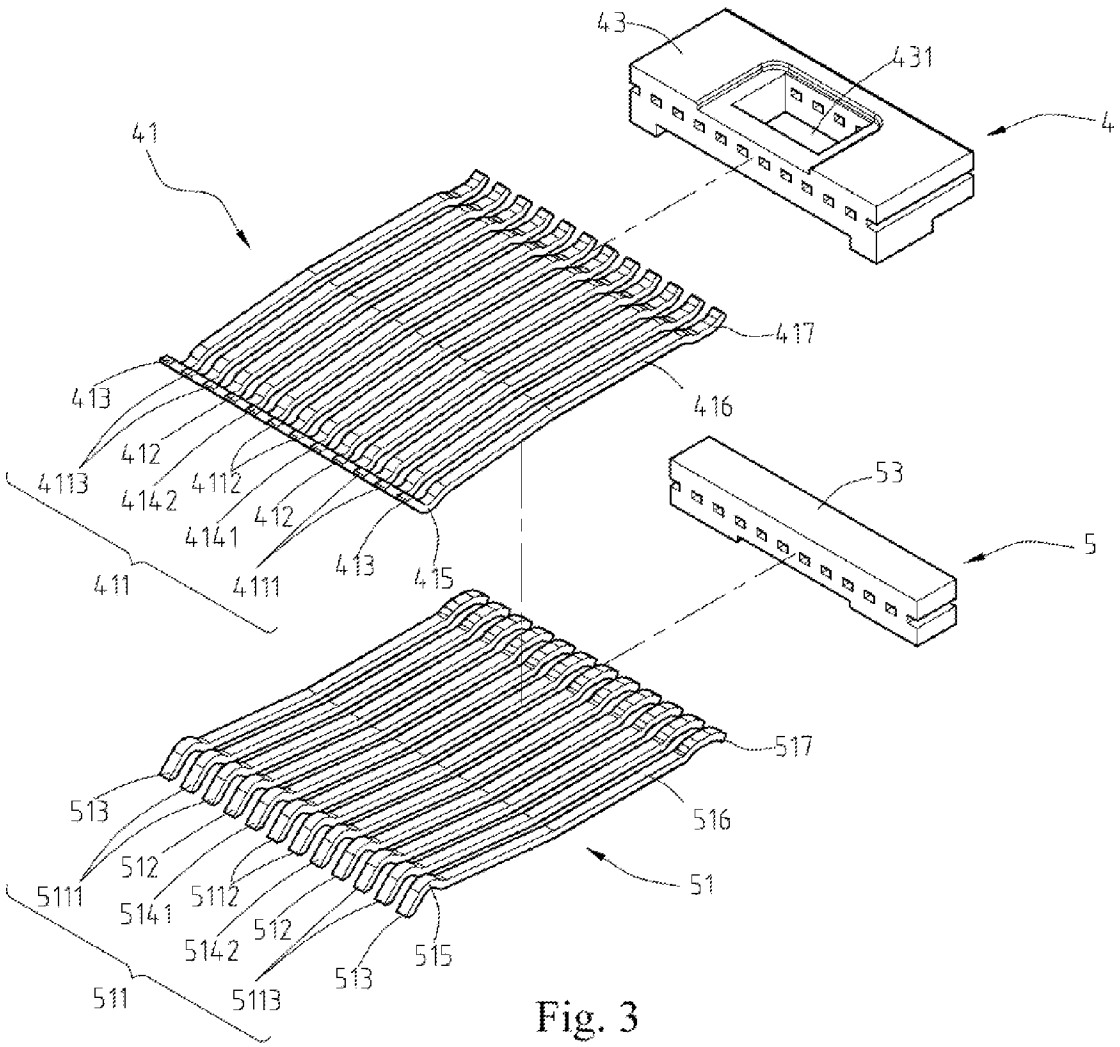
FIG. 3 illustrates an exploded view of a first terminal module and a second terminal module of the electrical plug connector of the first embodiment.
Figure 6:
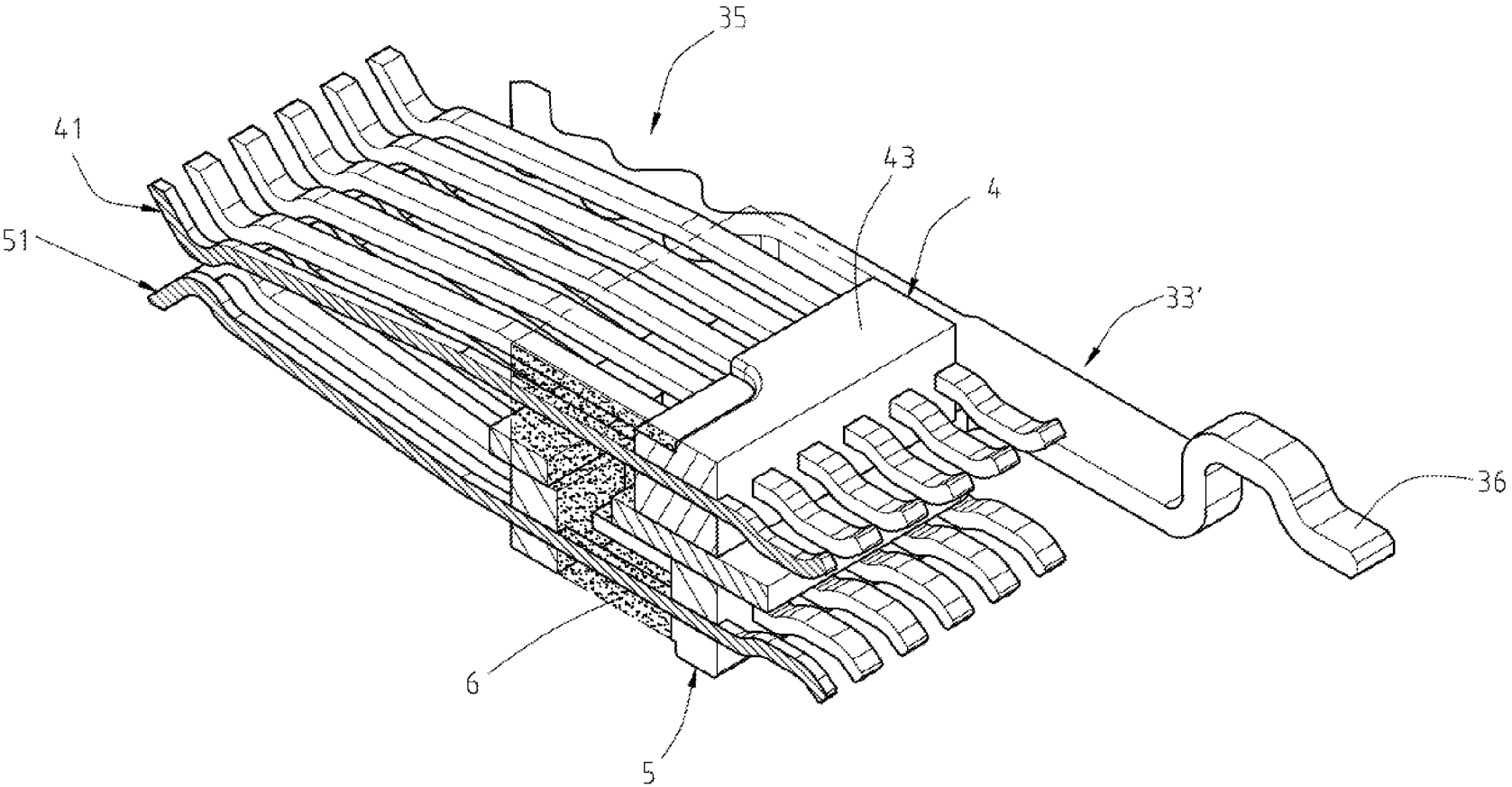
FIG. 6 illustrates sectional view of the assembly of the grounding plate, the first terminal module and the second terminal module of the electrical plug connector of the first embodiment.

Please refer to FIGS. 1 to 3, illustrating an electrical plug connector of a first embodiment of the instant disclosure. FIG. 1 illustrates a perspective view thereof, FIG. 2 illustrates an exploded view thereof, and FIG. 3 illustrates an exploded view of a first terminal module and a second terminal module thereof. In this embodiment, the electrical plug connector 100 can provide a reversible or dual orientation USB Type-C connector interface and pin assignments, i.e., a USB Type-C plug connector. In this embodiment, the electrical plug connector 100 comprises a metallic shell 11, an insulated housing 21, a grounding plate 3, a first terminal module 4, a second terminal module 5, and a molding block 6 (as shown in FIG. 6).

Please refer to FIGS. 1 and 2. In this embodiment, the metallic shell 11 is a hollowed shell formed by deep drawing techniques. In other words, the metallic shell 11 is a unitary member and is a seamless shell. The metallic shell 11 has a beautiful appearance and improved structural strength. In addition, the metallic shell 11 has a receiving cavity 111 therein. The metallic shell 11 encloses the insulated housing 21. In other words, the insulated housing 21 is received in the receiving cavity 111. In this embodiment, the metallic shell 11 is a unitary member, but embodiments are not limited thereto. In some embodiments, several pieces may be bent to form the metallic shell 11.

Figure 7:
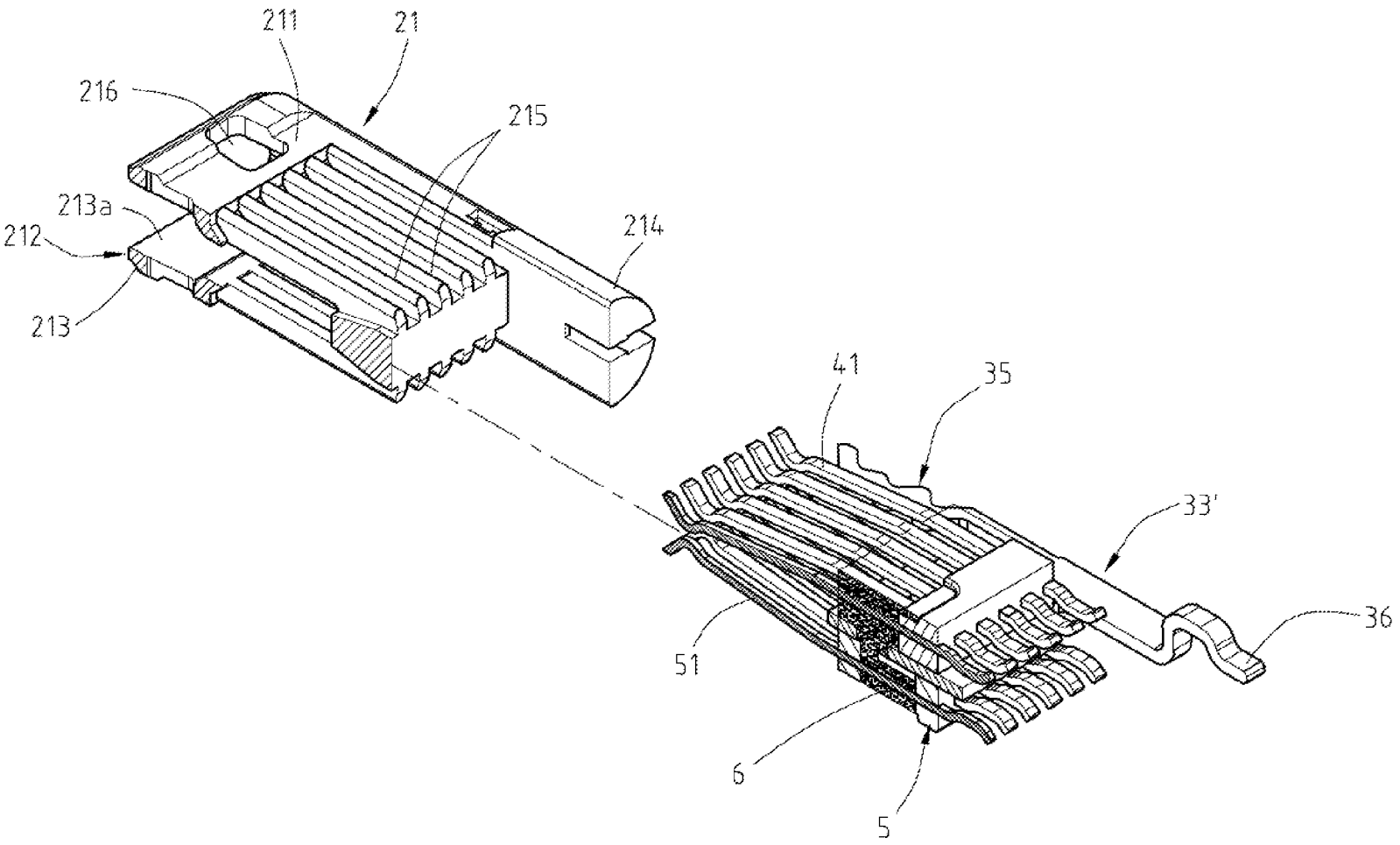
FIG. 7 illustrates a schematic sectional view (1) of the electrical plug connector of the first embodiment.
Figure 8:
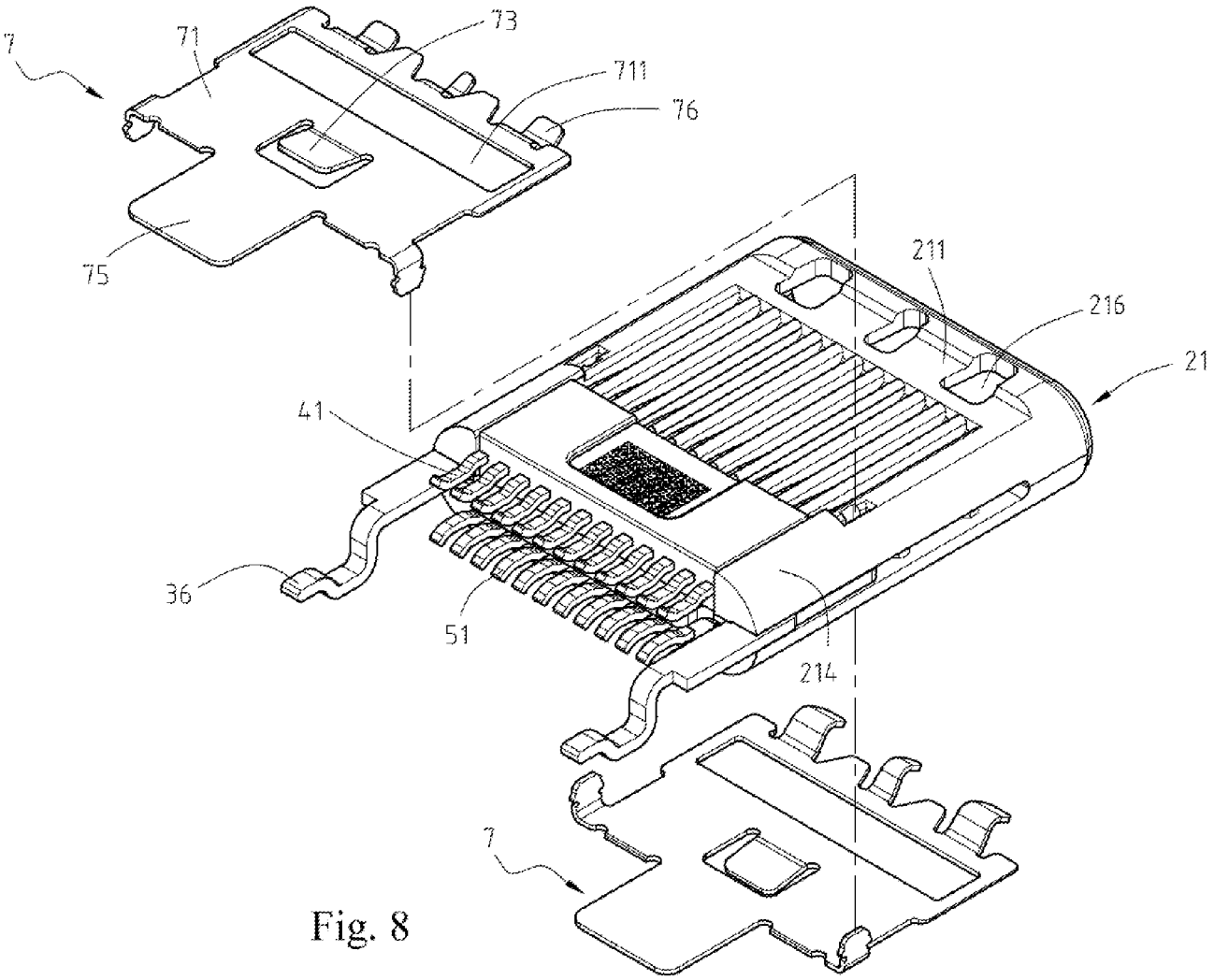
FIG. 8 illustrates a schematic sectional view (2) of the electrical plug connector of the first embodiment.

Please refer to FIGS. 2, 7, and 8. In this embodiment, the insulated housing 21 is a tubular elongated plate. The upper portion of the insulated housing 21 is symmetrical to the lower portion of the insulated housing 21, and the left portion of the insulated housing 21 is symmetrical to the right portion of the insulated housing 21. The insulated housing 21 comprises a first assembling portion 211, a second assembling portion 212, an insertion cavity 213, a plurality of terminal grooves 215, and an assembling recess 22. Wherein, the insulated housing 21 comprises the first assembling portion 211 (which may be an upper portion or a lower portion of the insulated housing 21) and the second assembling portion 212 (which may be an upper portion or a lower portion of the insulated housing 21) opposite to the first assembling portion 211. The insertion cavity 213 is between the first assembling portion 211 and the second assembling portion 212. The terminal grooves 215 are formed on the first assembling portion 211 and the second assembling portion 212 and in communication with the insertion cavity 213. In this embodiment, the first assembling portion 211 and the second assembling portion 212 are formed by injection molding. An opening 213*a* of the insertion cavity 213 is formed on a front portion of the insulated housing 21, and the assembling recess 22 is recessed from a rear portion of the insulated housing 21. In other words, the two sides of the rear portion of the insulated housing 21 have side walls 214, and a hollowed assembling region is between the two side walls 214. In addition, from a top view, the rear portion of the insulated housing 21 is U shaped. Moreover, the insertion cavity 213 is between the first assembling portion 211 and the second assembling portion 212. Each of the terminal grooves 215 is an elongate groove. Each of the terminal grooves 215 is arranged on the first assembling portion 211 and the second assembling portion 212 along a length direction, and each of the terminal grooves 215 are defined through the first assembling portion 211 and the second assembling portion 212 and respectively in communication with the insertion cavity 213.

Figure 5:
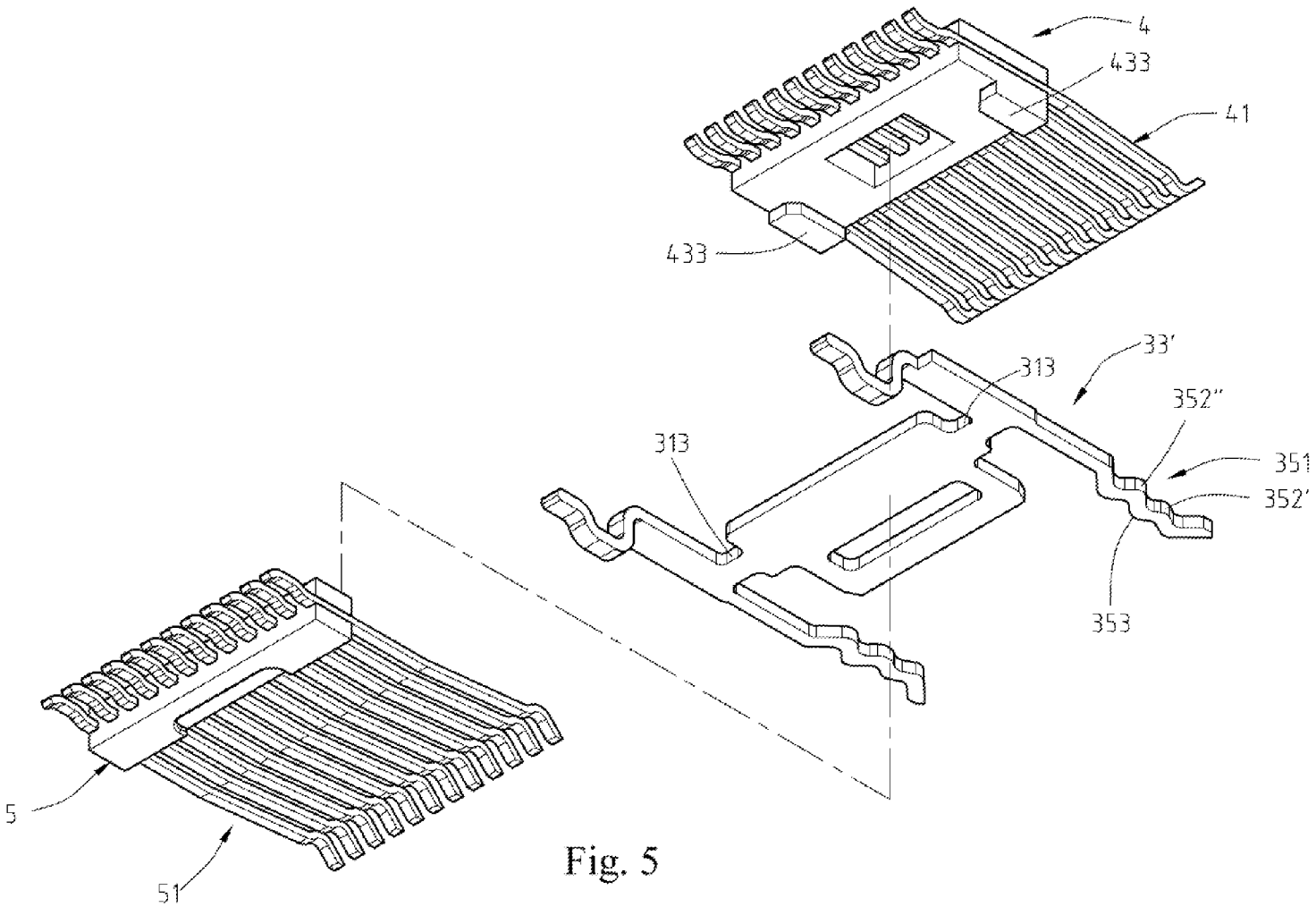
FIG. 5 illustrates an enlarged exploded view showing the grounding plate, the first terminal module and the second terminal module of the electrical plug connector of the first embodiment.

Please refer to FIGS. 2 and 5. In this embodiment, the grounding plate 3 is formed by blanking techniques but not limited thereto. In some embodiments, the grounding plate 3 may be formed by stamping techniques. A grounding plate 3 formed by blanking has a better structural strength than a grounding plate 3 formed by stamping. In addition, the grounding plate 3 is on the insulated housing 21 and in contact with the metallic shell 11. In this embodiment, the grounding plate 3 comprises a central combining plate 31, a positioning hole 311, and a plurality of side arms 33'. The central combining plate 31 is a rectangular plate and held in the assembling recess 22. The positioning hole 311 is defined through the central combining plate 31. Each of the side arms 33' is an elongate structure. The side arms 33' are symmetrical with each other, i.e., a first side arm 33' is mirrored with respect to its corresponding second side arm 33'. The side arms 33' are passing through notches at two sides of the insulated housing 21 and extending into the insertion cavity 213.

Figure 9:
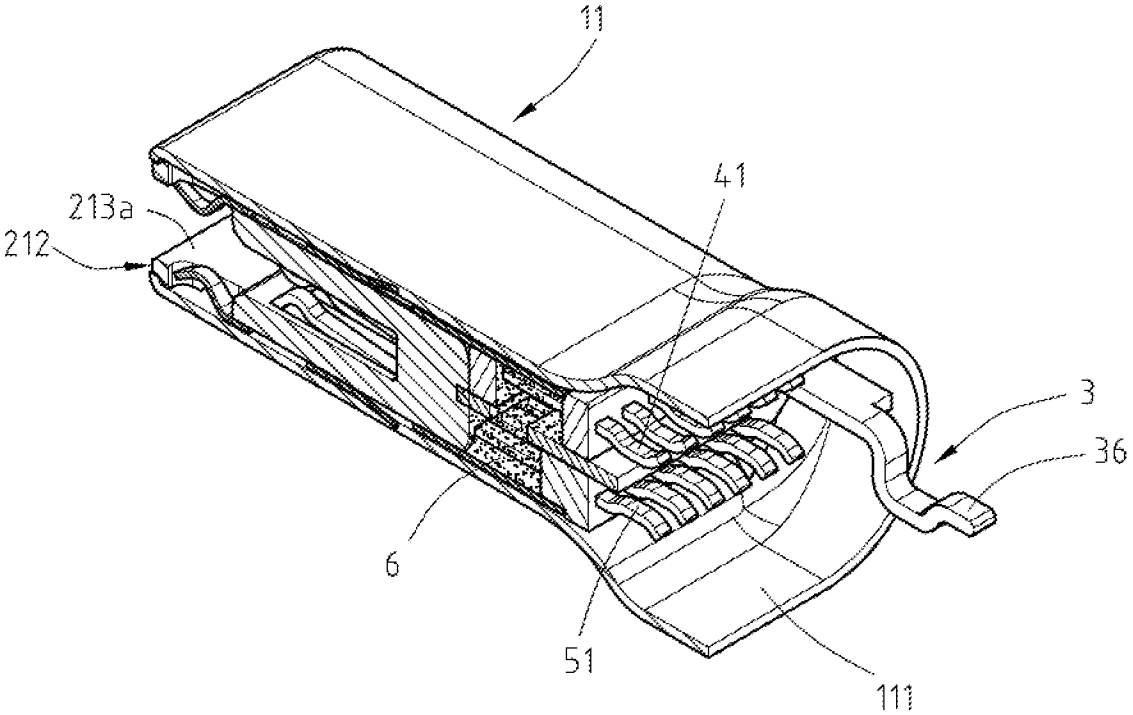
FIG. 9 illustrates a schematic sectional view (3) of the electrical plug connector of the first embodiment.

Please refer to FIGS. 2, 5, and 9. In this embodiment, the grounding plate 3 further comprises an embedded block 316 protruding outward from a front end of the central combining plate 31. During the assembling of the connector, the embedded block 316 is riveted in the insulated housing 21 to improve the overall structural strength of the connector. The central combining plate 31 is positioned in the assembling recess 22, and the central combining plate 31 is provided for shielding the first plug terminals 41 from the second plug terminals 51.

Please refer to FIGS. 2, 5, and 9. In this embodiment, the grounding plate 3 further comprises a rear protruding block 315 backwardly extending out of the insulated housing 21 from one side of the central combining plate 31. The rear protruding block 315 is between the first tail portions 417 and the second tail portions 517. Therefore, when the first tail portions 417 and the second tail portions 517 are in contact with a circuit board, the rear protruding portion 315 is abutted against a side portion of the circuit board and positions the tail portions 417, 517 properly.

Please refer to FIGS. 2, 8, and 9. In this embodiment, each of the side arms 33' further comprises an elastic contact portion 35 and a leg 36. Each of the elastic contact portions 35 is formed on a front portion of the corresponding side arm 33' for contacting an electrical receptacle connector. When an electrical receptacle connector is mated with the electrical plug connector 100, the elastic contact portions 35 allow the electrical plug connector 100 to be positioned with the electrical receptacle connector. Each of the legs 36 is outward extending, from a rear portion of the corresponding side arm 33', out of the insulated housing 21. The legs 36 are extending out of the insulated housing 21 to be in contact with a circuit board. In addition, in this embodiment, each of the legs 36 may comprises a hook structure protruding from an outer side thereof, and the hook structures can be abutted against the inner wall of the metallic shell 11 for positioning with the metallic shell 11.

Figure 10:
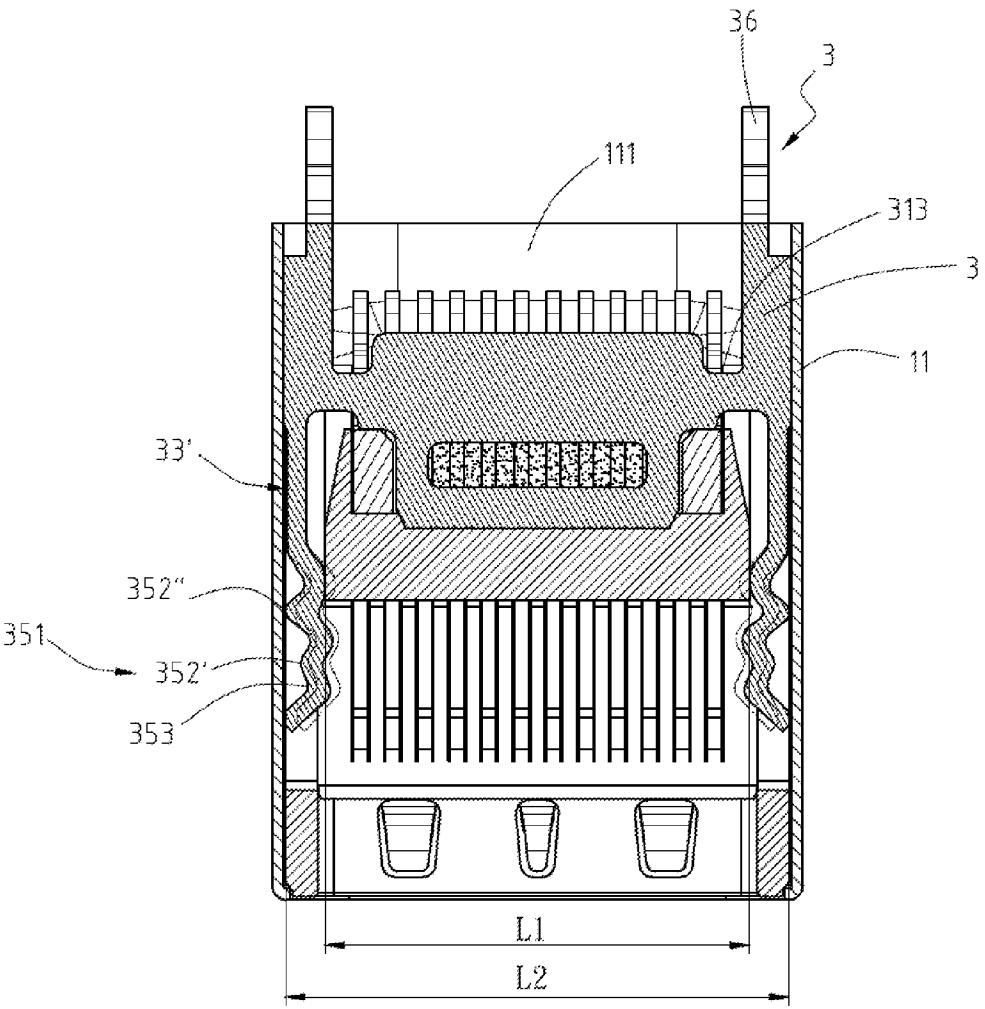
FIG. 10 illustrates a top sectional view of the electrical plug connector of the first embodiment.

Please refer to FIGS. 2, 5, and 10. In this embodiment, each of the elastic contact portions 35 is a wavy shaped structure 351, and the wavy shaped structures 351 are opposite with each other. Each of the wavy shaped structures 351 comprises a plurality of peak portions 352'/352" and a plurality of valley portions 353 in series connection. From a top view of the wavy shaped structures 351, a distance L1 between the peak portions 352' near to the opening 213*a* of the insertion cavity 213 is less than a distance L2 between the peak portions 352" within the insertion cavity 213. In other words, the distance L1 between the two peak portions 352' in a first group that are near to the opening 213*a* of the insertion cavity 213 is less than the distance L2 between the two peak portions 352" in a second group that are within the insertion cavity 213. When the electrical plug connector 100 is mated with an electrical receptacle connector, the electrical receptacle connector pushes against the wavy shaped structures 351, the two peak portions 352" in the second group are respectively in contact with the inner wall of the metallic shell 11, and the peak portions 352' in the first group are suspended upon the metallic shell 11 to provide a spring force. Therefore, when the electrical plug connector 100 is mated with an electrical receptacle connector, the wavy shaped structures 351 can be provided for holding the electrical receptacle connector.

Please refer to FIGS. 2, 3, and 5. In this embodiment, the first terminal module 4 comprises a plurality of first plug terminals 41, a first combining block 43, and a combining hole 431. The flexible contact portion 415 of each of the first plug terminals 41 is passing through the corresponding terminal groove 215 and extending toward the insertion cavity 213. The first combining block 43 is formed with the first body portions 416 of the first plug terminals 41 and positioned on one of two surfaces of the central combining plate 31. The combining hole 431 is defined through the first assembling block 43 and corresponding to the positioning hole 311.

Please refer to FIGS. 3, 5, and 6. In this embodiment, the first combining block 43 is combined with the first body portions 416 of the first plug terminals 41 by insert-molding to form the first terminal module 4, and the second combining block 53 is combined with the second body portions 516 of the second plug terminals 51 by insert-molding to form the second terminal module 5. A width of the first combining block 43 is greater than a width of the second combining block 53. By applying the insert-molding techniques, the design of molds can be simplified, and the manufacture of the product can be stably. Hence, the surfaces of the first plug terminals 41 can be flushed with each other, the surfaces of the second plug terminals 51 can be flushed with each other, and the first plug terminals 41 and the second plug terminals 51 can be positioned properly. Next, the first terminal module 4 and the second terminal module 5 are respectively assembled to an upper portion and a lower portion of the grounding plate 3. In this embodiment, the grounding plate 3 further comprises a plurality of engaging grooves 313 on two sides of the central combining plate 31, and the first terminal module 4 further comprises a plurality of engaging blocks 433 protruding from two sides of the first combining block 43. The engaging blocks 433 are respectively engaged with the respective engaging grooves 313. Therefore, the first terminal module 4 can be firmly positioned with the grounding plate 3, and the first terminal module 4 can be assembled with the grounding plate 3 in an easy manner. Then, the first terminal module 4, the grounding plate 3, and the second terminal module 5 are stacked in order. Next, liquid glue is poured into the combining hole 431, through the positioning hole 311, to two sides of the second combining block 53. The liquid glue is dried and set to form a molding block 6. Accordingly an assembly of the first terminal module 4, the grounding plate 3, and the second terminal module 5 can be formed. In other words, the molding block 6 is in the combining hole 431 and extends from the combining hole 431, through the positioning hole 311, to two sides of the second combining block 53, so that the first terminal module 4, the grounding plate 3, and the second terminal module 5 can be firmly combined with each other.

Please refer to FIGS. 2, 6, and 7. Next, the assembly of the first terminal module 4, the grounding plate 3, and the second terminal module 5 is assembled with the insulated housing 21, so that the first combining block 43 and the second combining block 53 are positioned in the assembling recess 22, and the first flexible contact portions 415 and the second flexible contact portions 515 are inserted into and positioned in the insertion cavity 213.

Please refer to FIGS. 2, 8, and 9. In this embodiment, the electrical plug connector 100 further comprises a plurality of abutting sheets 7 each comprising a body 71, a pin 73, and an extension sheet 75. The bodies 71 are fixed on the first assembling portion 211 and the second assembling portion 212, respectively. Each of the pins 73 is extending outward from a surface of the corresponding body 71 and in contact with the inner wall of the metallic shell 11 for providing grounding functions. Moreover, each of the extension sheets 75 is extending from a rear portion of the corresponding body 71 and in contact with the inner wall of the metallic shell 11. In this embodiment, the extension sheets 75 are fixed with the metallic shell 11 by laser welding. Furthermore, the insulated housing 21 comprises three trapezoidal holes 216 for mating with abutting pieces 76 extending from a front portion of each of the bodies 71. The number of the abutting pieces 76 corresponds to that of the trapezoidal holes 216. The abutting pieces 76 are inserted into the insertion cavity 213 through the trapezoidal shaped holes 216. Therefore, when the electrical plug connector 100 is mated with an electrical receptacle connector, the electrical receptacle connector is in contact with and held by the abutting pieces 76. Additionally, a rectangular slot 711 is formed on the front portion of each of the bodies 71, so that the first flexible contact portions 415 and the second flexible contact portions 515 can be respectively deflected toward the rectangular slots 711 and not in contact with the abutting sheets 7 upon the electrical plug connector 100 is mated with an electrical receptacle connector.

Please refer to FIGS. 3, 4, and 6. In this embodiment, the first plug terminals 41 comprise a plurality of signal terminals 411, at least one power terminal 412, and at least one ground terminal 413. The first plug terminals 41 are held in the insulated housing 21 and disposed upon a lower surface (i.e., a first mating surface) of the first assembling portion 211. As shown in FIG. 4, the first plug terminals 41 comprise, from right to left, a ground terminal 413 (Gnd), a first pair high-speed signal terminals 4111 (TX1+−, differential signal terminals), a power terminal 412 (Power/VBUS), a first function detection terminal 4141 (CC1, a terminal for inserting orientation detection of the connector and for cable recognition), a pair of low-speed signal terminals 4112 (D+−, differential signal terminals), a first reserved terminal 4142, another power terminal 412 (Power/VBUS), a second pair of high-speed signal terminals 4113 (RX2+−, differential signal terminals), and another ground terminal 413 (Gnd).

Please refer to FIGS. 3 and 4. Each of the first plug terminals 41 comprises a first flexible contact portion 415, a first body portion 416, and a first tail portion 417. In this embodiment, the first body portions 416 are held in the first assembling portion 211, the first flexible contact portion 415 is extending forward from the first body portion 416 in the rear-to-front direction and disposed upon the first mating surface of the first assembling portion 211, the first tail portion 417 is extending backward from the first body portion 416 in the front-to-rear direction, and the first tail portions 417 are bent and protruding out of the insulated housing 21. The first tail portion 417 has a curved profile. The first plug terminals 41 are extending toward the insertion cavity 213 for transmitting first signals (i.e., USB 3.0 signals).

Please refer to FIGS. 3, 4, and 6. The second terminal module 5 comprises a plurality of second plug terminals 51 and a second combining block 53. One end of each of the second plug terminals 51 is passing through the corresponding terminal groove 215 and extending toward the insertion cavity 213. The second combining block 53 is formed with the second plug terminals 51 and positioned on the other surface of the central combining plate 31.

Please refer to FIGS. 3 and 4. The second plug terminals 51 are held in the insulated housing 21 and disposed upon an upper surface (i.e., a second mating surface) of the second assembling portion 212. As shown in FIG. 4, the second plug terminals 51 comprise, from left to right, a ground terminal 513 (Gnd), a first pair high-speed signal terminals 5111 (TX2+−, differential signal terminals), a power terminal 512 (Power/VBUS), a second function detection terminal 5141 (CC2, a terminal for inserting orientation detection of the connector and for cable recognition), a pair of low-speed signal terminals 5112 (D+−, differential signal terminals), a second reserved terminal 5142, another power terminal 512 (Power/VBUS), a second pair of high-speed signal terminals 5113 (RX1+−, differential signal terminals), and another ground terminal 513 (Gnd).

Please refer to FIGS. 3, 4, and 6. Each of the second plug terminals 51 comprises a second flexible contact portion 515, a second body portion 516, and a second tail portion 517. The second body portions 516 are held in the second assembling portion 212, the second flexible contact portion 515 is extending forward from the second body portion 516 in the rear-to-front direction and disposed upon the second mating surface of the second assembling portion 212, the second tail portion 517 is extending backward from the second body portion 516 in the front-to-rear direction, and the second tail portions 517 are bent and protruding out of the insulated housing 21. The second tail portion 517 has a curved profile, and the second tail portions 517 correspond to the first tail portions 417. In other words, for example, the first tail portion 417 may be curved inward but the corresponding second tail portion 517 may be curved outward. Each of the first tail portions 417 and the corresponding second tail portion 517 form a clamp for holding and contacting a circuit board. Moreover, the second plug terminals 51 are extending toward the insertion cavity 213 for transmitting second signals (i.e., USB 3.0 signals).

Please refer to FIGS. 2, 3, and 10. In this embodiment, the first plug terminals 41 and the second plug terminals 51 are respectively held on the first mating surface of the first assembling portion 211 and the second mating surface of the second assembling portion 212. Moreover, pin-assignments of the first plug terminals 41 and the second plug terminals 51 are point-symmetrical with a central point of the receiving cavity 111 as the symmetrical center. In other words, pin-assignments of the first plug terminals 41 and the second plug terminals 51 have 180-degree symmetrical design with respect to the central point of the receiving cavity 111 as the symmetrical center. The dual or double orientation design enables the electrical plug connector 100 to be inserted into an electrical receptacle connector in either of two intuitive orientations, i.e., in either upside-up or upside-down directions. Here, point-symmetry means that after the first plug terminals 41 (or the second plug terminals 51), are rotated by 180 degrees with the symmetrical center as the rotating center, the first plug terminals 41 and the second plug terminals 51 are overlapped. That is, the rotated first plug terminals 41 are arranged at the position of the original second plug terminals 51, and the rotated second plug terminals 51 are arranged at the position of the original first plug terminals 41. In other words, the first plug terminals 41 and the second plug terminals 51 are arranged upside down, and the pin assignments of the first plug terminals 41 are left-right reversal with respect to that of the second plug terminals 51. Therefore, the electrical plug connector 100 may be inserted into an electrical receptacle connector with a first orientation where the first mating surface is facing down, for transmitting first signals. Conversely, the electrical plug connector 100 may also be inserted into the electrical receptacle connector with a second orientation where the first mating surface is facing up, for transmitting second signals. Furthermore, the specification for transmitting the first signals is conformed to the specification for transmitting the second signals. Note that, the inserting orientation of the electrical plug connector 100 is not limited by the electrical receptacle connector. Furthermore, in this embodiment, the first flexible contact portions 415 correspond to the second flexible contact portions 515.

Figure 11:
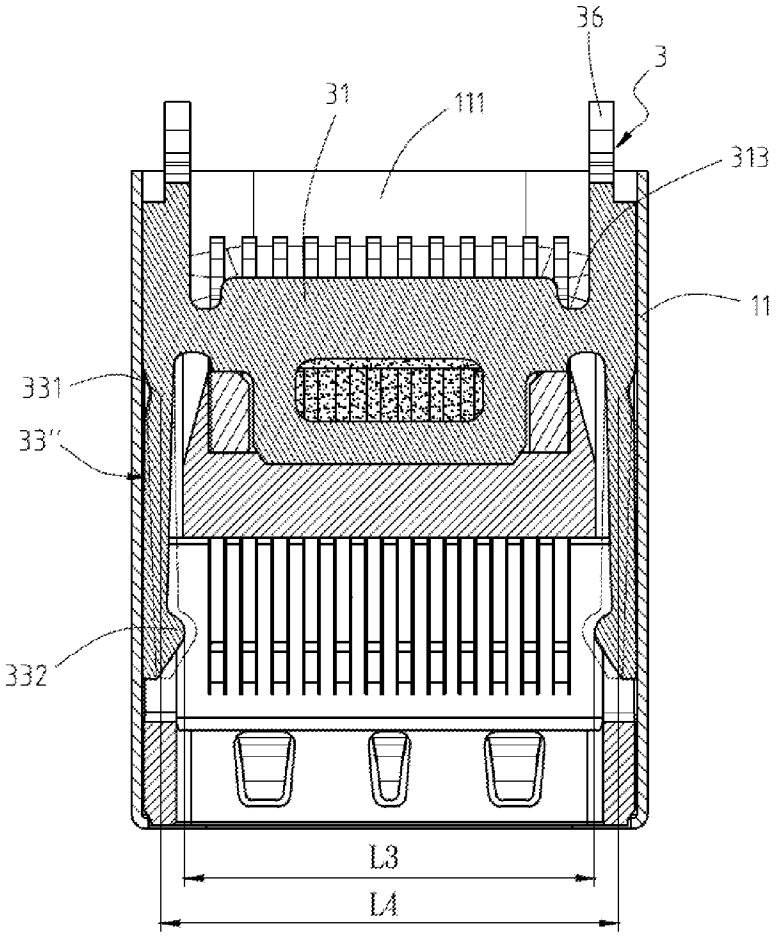
FIG. 11 illustrates a top sectional view of an electrical plug connector according a second embodiment of the instant disclosure.

FIG. 11 illustrates an electrical plug connector 100 of a second embodiment of the instant disclosure. In the second embodiment, each of the side arms 33" of the grounding plate 3 comprises a root portion 331 and a contact end 332. The root portions 331 are at two sides of the central combining plate 31. The contact ends 332 are extending toward two sides of the insertion cavity 213. In other words, each of the contact ends 332 is extending toward the insertion cavity 213 from the corresponding root portion 331. The side arms 33" are obliquely aligned, i.e., a distance L3 between the contact ends 332 is less than a distance L4 between the root portions 331. Accordingly, the grounding plate 3 of the second embodiment can be manufactured easily because of the simple structure of the side arms 33". In other words, as compare with the grounding plate 3 having wavy shaped structure 351 in the first embodiment, the grounding plate 3 in the second embodiment can be manufactured easily. In the second embodiment, the contact ends 332 of the grounding plate 3 can be in contact with an electrical receptacle connector, and the side arms 33" can provide a spring force. Therefore, when the electrical plug connector 100 is mated with an electrical receptacle connector, each of the side arms 33" is deflected using the root portion 331 as a fulcrum. Accordingly, the side arms 33" that are obliquely aligned can be deflected widely and provide a better holding function to the electrical receptacle connector.

As above, the first combining block is formed with the first plug terminals by insert-molding techniques, and the second combining block is formed with the second plug terminals by insert-molding techniques. Then, the first combining block (along with the first plug terminals) and the second combining block (along with the second plug terminals) are respectively assembled to the upper portion and the lower portion of the grounding plate, so that the first combining block, the second combining block, and the central combining plate can be firmly assembled with each other. Moreover, because of the structure of the side arms which may be obliquely aligned or may have a wavy shaped structure, the side arms can provide a spring force. Accordingly, when the electrical plug connector is mated with an electrical receptacle connector, the side arms can hold the electrical receptacle connector firmly.

Furthermore, the first plug terminals and the second plug terminals are arranged upside down, and the pin-assignment of the first flexible contact portions is left-right reversal with respect to that of the second flexible contact portions. Accordingly, the electrical plug connector can have a 180 degree symmetrical, dual or double orientation design and pin assignments which enables the electrical plug connector to be mated with a corresponding receptacle connector in either of two intuitive orientations, i.e. in either upside-up or upside-down directions. Therefore, when the electrical plug connector is inserted into the electrical receptacle connector with a first orientation, the first flexible contact portions are in contact with upper-row receptacle terminals of the electrical receptacle connector. Conversely, when the electrical plug connector is inserted into the electrical receptacle connector with a second orientation, the second flexible contact portions are in contact with the upper-row receptacle terminals of the electrical receptacle connector. Note that, the inserting orientation of the electrical plug connector is not limited by the electrical receptacle connector.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell having a receiving cavity therein;

an insulated housing received in the receiving cavity of the metallic shell, wherein the insulated housing comprises a first assembling portion and a second assembling portion corresponding to the first assembling portion, an insertion cavity is between the first assembling portion and the second assembling portion, a plurality of terminal grooves is respectively formed on the first assembling portion and the second assembling portion and in communication with the insertion cavity, an opening of the insertion cavity is on one of two sides of the insulated housing, and an assembling recess is recessed from the other side of the insulated housing, and the other side of the insulated housing is U shaped from a top view;

a grounding plate on the insulated housing, wherein the grounding plate comprises a central combining plate, a positioning hole, and a plurality of side arms, the central combining plate is held in the assembling recess, the positioning hole is defined through the central combining plate, and the side arms are respectively extending toward the insertion cavity from two sides of the central combining plate;

a first terminal module comprising a plurality of first plug terminals, a first combining block, and a combining hole, wherein each of the first plug terminals is held in the first assembling portion, one end of each of the first plug terminals is passing through the corresponding terminal groove and extending toward the insertion cavity, the first combining block is formed with the first plug terminals, positioned on one of two surfaces of the central combining plate, and positioned in the assembling recess, the combining hole is defined through the first assembling block and corresponding to the positioning hole;

a second terminal module comprising a plurality of second plug terminals and a second combining block, wherein each of the second plug terminals is held in the second assembling portion, one end of each of the second plug terminals is passing through the corresponding terminal groove and extending toward the insertion cavity, the second combining block is formed with the second plug terminals, positioned on the other surface of the central combining plate, and positioned in the assembling recess; and a molding block in the combining hole and extending from the combining hole, through the positioning hole, to two sides of the second combining block.

2. The electrical plug connector according to claim 1, wherein the grounding plate comprises a plurality of engaging grooves on two sides of the central combining plate, wherein the first terminal module comprises a plurality of engaging blocks each protruding from the first combining block and engaged with the corresponding engaging groove.

3. The electrical plug connector according to claim 1, wherein the grounding plate comprises a rear protruding block outwardly extending, from one side of the central combining plate, out of the insulated housing.

4. The electrical plug connector according to claim 1, wherein each of the side arms comprises a root portion and a contact end, the root portions are at two sides of the central combining plate, the contact ends are in two sides of the insertion cavity, a distance between the contact ends is less than a distance between the root portions.

5. The electrical plug connector according to claim 1, wherein the grounding plate comprises an embedded block protruding from a front end of the central combining plate and assembled to the insulated housing.

6. The electrical plug connector according to claim 1, further comprising a plurality of abutting sheets each comprises a body, a pin, and an extension sheet, the bodies are fixed on the first assembling portion and the second assembling portion, each of the pins is extending outward from a surface of the corresponding body and in contact with an inner wall of the metallic shell, each of the extension sheets is extending from a rear portion of the corresponding body and in contact with the inner wall of the metallic shell.

7. The electrical plug connector according to claim 1, wherein each of the first plug terminals comprises a first flexible contact portion, a first body portion, and a first tail portion, the first body portions are held in the first assembling portion, the first flexible contact portion is extending forward from the first body portion in the rear-to-front direction and disposed upon a first mating surface of the first assembling portion, the first tail portion is extending backward from the first body portion in the front-to-rear direction, and the first tail portions are bent and protruding out of the insulated housing.

8. The electrical plug connector according to claim 1, wherein each of the second plug terminals comprises a second flexible contact portion, a second body portion, and a second tail portion, the second body portions are held in the second assembling portion, the second flexible contact portion is extending forward from the second body portion in the rear-to-front direction and disposed upon a second mating surface of the second assembling portion, the second tail portion is extending backward from the second body portion in the front-to-rear direction, and the second tail portions are bent and protruding out of the insulated housing.

9. The electrical plug connector according to claim 1, wherein each of the side anus comprises an elastic contact portion and a leg, each of the elastic contact portions is formed on a front portion of the corresponding side arm, and each of the legs is outward extending, from a rear portion of the corresponding side arm, out of the insulated housing.

10. The electrical plug connector according to claim 9, wherein each of the elastic contact portions is a wavy shaped structure, and the wavy shaped structures are opposite with each other, each of the wavy shaped structures comprises a plurality of peak portions and a plurality of valley portions in series connection, a distance between the peak portions near to the opening of the insertion cavity is less than a distance between the peak portions within the insertion cavity.

* * * * *